United States Patent [19]

Handler

[11] Patent Number: 4,676,655

[45] Date of Patent: Jun. 30, 1987

[54] PLUNGER TYPE CARTRIDGE MIXER FOR FLUENT MATERIALS

[76] Inventor: Isidore Handler, 2960 Kinloch Rd., Wantagh, N.Y. 11793

[21] Appl. No.: 798,899

[22] Filed: Nov. 18, 1985

[51] Int. Cl.[4] ..... B01F 5/04; B01F 7/00

[52] U.S. Cl. ..... 366/130; 366/289; 366/309; 366/332; 366/333

[58] Field of Search ..... 366/130, 333, 289, 309, 366/332; 222/190

[56] References Cited

U.S. PATENT DOCUMENTS

| | | | |
|---|---|---|---|
| 1,998,692 | 4/1935 | Rossem et al. | 366/333 |
| 3,164,303 | 1/1965 | Trautmann | 366/333 X |
| 3,195,778 | 7/1965 | Coates | 222/190 X |
| 3,475,010 | 10/1969 | Cook et al. | 366/333 |
| 3,794,221 | 2/1974 | Hostettler et al. | 222/190 |
| 4,371,094 | 2/1983 | Hutter, III | 366/333 X |
| 4,469,153 | 9/1984 | Morrisette | 366/333 X |
| 4,497,578 | 2/1985 | Simpson | 366/333 X |

FOREIGN PATENT DOCUMENTS

| | | | |
|---|---|---|---|
| 0012726 | 6/1980 | European Pat. Off. | 366/333 |
| 612636 | 4/1935 | Fed. Rep. of Germany | 366/333 |
| 2162091 | 7/1972 | Fed. Rep. of Germany | 366/332 |

*Primary Examiner*—Robert R. Mackey

*Attorney, Agent, or Firm*—Ostrolenk, Faber, Gerb & Soffen

[57] ABSTRACT

A fluent material mixer having a bottom barrel section with a mixed material exit and an upper barrel section from which an operating plunger shaft projects. The two barrel sections contain materials which are separated from each other and are to be mixed together prior to extrusion. A breakable separator is disposed between the barrel sections. A fluent material mixer plate with material bypassing holes defined in it is disposed on and movable through the barrel sections by the plunger shaft. A wiper is detented to position at the upper end of the upper barrel section. The wiper includes a plate without openings through it and it sealingly engages the interior of the barrel sections. A sleeve at the radially inward edge of the wiper wraps around the shaft for sealing against fluent materials moving out of the barrel sections along the shaft. Movable latches on the wiper plate are movable into a notch on the shaft for locking the wiper to the shaft, so that the wiper can thereafter be moved through the barrel sections along with the shaft to push mixed fluent materials out of the exit.

21 Claims, 15 Drawing Figures

66
64
11
62
67
65
52
54
78
88
86
53
56
62a
89
50
63a
51
7

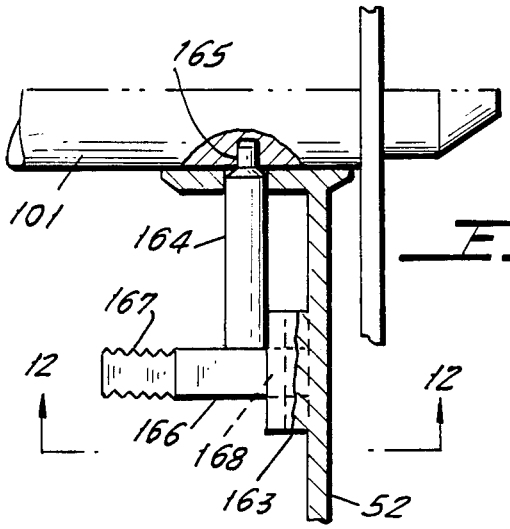
FIG. 13.
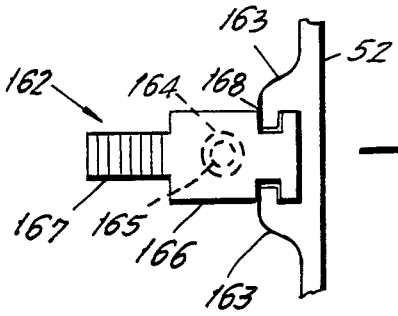
FIG. 12.
FIG. 14.
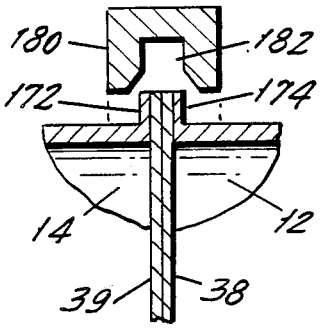
FIG. 15.
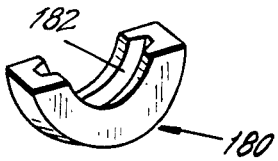

PLUNGER TYPE CARTRIDGE MIXER FOR FLUENT MATERIALS

BACKGROUND OF THE INVENTION

The present invention relates to a cartridge mixer for mixing two fluent materials and particularly to such a mixer wherein the two fluent materials are kept separated in the cartridge body prior to their mixing and subsequent dispensing.

The fluent materials to be mixed with the mixer according to the invention are of unlimited variety. Their characteristic is that they are not sufficiently liquid that they can be thoroughly mixed by agitation of the mixer body, but they must instead be assisted by a mixing apparatus that moves through the fluent materials to mix them. Furthermore, the two materials typically react in some manner when they are mixed, and it is desirable therefore to keep the materials separated until they are mixed. For example, these mixers may be used for mixing two quite viscous, fluent materials which react to form a foam that hardens shortly after it is mixed. In particular, the mixer can be used to mix a base material and a catalyst to produce sealant compound. In the example wherein the fluent materials are mixed and the foam begins to form, the volume occupied by the combined, reacted materials is larger than that occupied by its previously separated components. The foam must be dispensed because as the foam further expands, it would occupy still more volume and furthermore, as the foam gradually hardens, it would make subsequent dispensing and use of the foam impossible.

Various mixers for mixing two such fluent materials are known. One type of mixer shown in U.S. Pat. No. 3,144,966 includes two compartments or chambers in a single body, and the chambers are separated by a breakable separator. A plunger supports a mixer which is movable through the body to mix the fluent materials. In a known modification of the patented disclosure, the separated components are held in two chambers within the body, and the mixer is moved through both chambers of the body, first to pierce and break the separator and thereafter to be moved back and forth to mix the materials. Once the fluent materials have been mixed, the plunger is operated to move the product dispensing means to dispense the product through the exit from the body.

The cartridge is typically a single use, disposable unit and its design is preferably simple and inexpensive.

SUMMARY OF THE INVENTION

Accordingly, it is the primary object of the present invention to provide an improved, effective, simplified and preferably inexpensive plunger type cartridge mixer for mixing two previously separated fluent materials.

It is another object of the invention to provide such a mixer wherein the handle which operates the mixer also directly operates the means in the mixer for dispensing the contents from the mixer body when the materials have been mixed.

It is yet another object of the invention to provide such a mixer wherein the dispensing means is simply activated to be operated by the handle when the dispensing is required.

It is still another object of the invention to provide separate component bodies that compose the outer shell of the cartridge, in the form of the upper barrel and lower barrel. Separate barrels can easily be filled by a standard filling machine, avoiding the need for a complicated expensive and special filling machine and method.

Another object of the invention is to avoid the need for a specially inserted separator inside the body of the cartridge. Such a separator is very expensive and makes the ensuing filling operation very expensive.

It is still a further object of the invention to avoid the need to press the cartridge radially, i.e. to pinch it, to start the reaction between the two fluids. The prior pinching operation was done to partially crimp the separator so that the mixer could plunge through the cartridge easily. The crimping of the separator was found to be ineffective.

It is yet another object of the invention that the straight push of the handle will eject the material from the cartridge. There is no need to turn the cartridge around and to remove the handle therefrom.

According to the present invention, the cartridge mixer includes a main body of generally cylindrical shape and having two barrel sections which, for simplicity in naming them, are referred to as the lower barrel section, including the dispensing outlet exit, and the upper barrel section, out of which the plunger of the operating handle extends. Both the lower and the upper barrel sections have respective open ends which open toward each other. A breakable separator, in the form of a respective separation disk which covers each of the abutting open ends of the barrel sections, is held between the attached sections. Those disks may be in the form of a breakable strip of foil which is non-reactive with the fluent materials.

Toward the top of the upper barrel section, there is disposed a unit which is a combined plunger wiper and mixed fluent material dispenser or pusher. The main body of the wiper is an annular plate which extends across the upper end region of the upper barrel section. Radially inward of the plate of the wiper is a wiper sleeve which defines an opening shaped to surround the plunger shaft, for blocking bypassage of fluent material past the wiper. The radially inner section of the wiper includes an upwardly extending sleeve. This sleeve is provided with a pair of opposite openings which register with latch receiving means in the plunger in the form of an annular notch. The wiper plate is provided with manually operated latches which are supported by the sleeve openings. The latches are movable into the annular notch to interconnect the wiper with the plunger for vertical movement with the plunger to dispense the mixed material from the main body.

At the radially outward edge of the wiper plate is a flange which engages the interior of the upper barrel section to seal it against the bypassage of the fluent material. Detent means are defined at the radially outward edge of the wiper on the flange and on the upper barrel section for holding the wiper at the top of the upper barrel section while the plunger moves back and forth through the main body.

The mixer plunger shaft includes, as above described, at its bottom end an annular notch into which latches on the wiper may be introduced by the user to lock the wiper to the plunger shaft.

A mixer is disposed at the bottom end of the plunger shaft. It comprises a mixer plate which extends across the barrel. The top or bottom surface of the mixer plate, which is then facing in the direction of motion of the mixer plate, pushes fluent material before it. The plate also has openings through it so that the fluent materials will also bypass the mixer plate. The shaping of the plate openings and the movement of the plate together promote the complete mixing of the fluent materials which is accomplished after a few reciprocations of the mixer through the main body. Furthermore, a crank handle on the plunger shaft enables the shaft to be rotated, especially as the shaft is being moved, which aids the mixing.

Once mixing has been completed and the mixed product is to be dispensed, the cap over the outlet exit from the lower barrel section is removed, the latches carried by the wiper are manually operated to engage in the annular notch of the plunger shaft, and the detent means on the wiper at the top of the body also are operated to release the wiper from its detented upraised position in the upper barrel section. Then the downward movement of the plunger into the main body moves the wiper through the body, which causes the wiper to push the mixed materials out the exit at the bottom of the main body.

Other objects and features of the present invention will be apparent from the following description of preferred embodiments of the invention considered in conjunction with the accompanying drawings.

BRIEF DESCRIPTION OF THE DRAWINGS

FIG. 12 shows an end view of an alternate latch on the wiper plate;

FIG. 13 is a side view of the latch of FIG. 12;

FIG. 14 is a fragmentary cross-sectional view of the alternative attachment for the two barrel sections of the cartridge; and FIG. 15 is a perspective view of a split ring useful in the attachment of FIG. 14.

DETAILED DESCRIPTION OF THE PREFERRED EMBODIMENT

Figures 1, 2, 3:
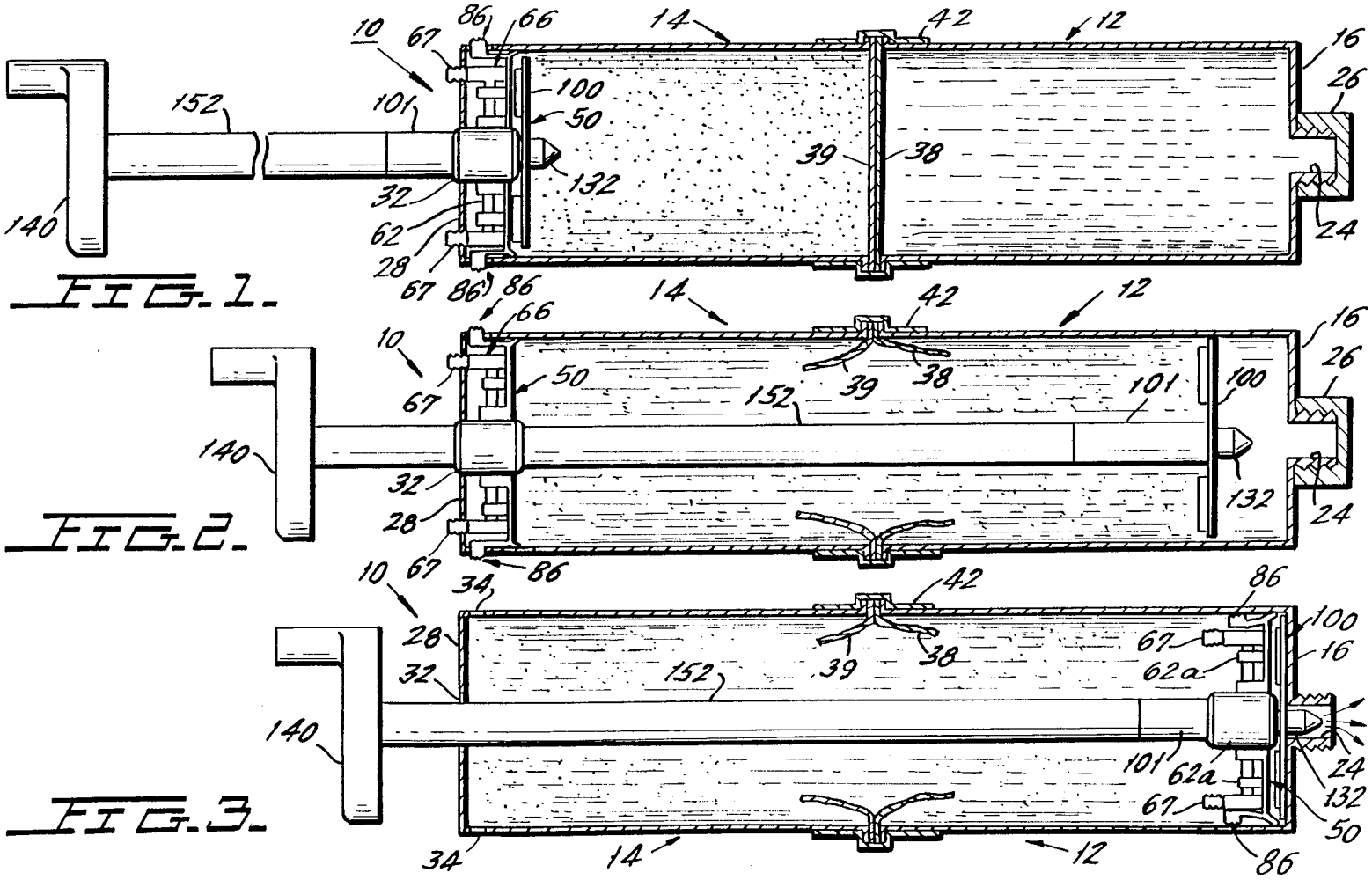
FIG. 1 is a side cross-sectional view of the mixing apparatus according to the present invention in the position before operation of the plunger.
FIG. 2 is the same type of view as FIG. 1 after the mixing plunger has been operated to mix the fluent materials.
FIG. 3 is the same type of view as FIG. 1 showing the mixed contents being expelled.

The plunger mixer cartridge 10 according to the present invention includes a cylindrical main body or barrel that is comprised of the bottom and upper sections 12 and 14, respectively. The material of the body is impervious to and does not react with the separate and later combined fluent materials being mixed. The bottom section 12 is a cylinder, which is open at its upper end facing the upper section 14 and which is closed off by an annular wall 16 at its bottom end. The wall 16 has an outlet through it comprising a narrowed diameter protruding exit neck 24 which is externally threaded to receive the screw threaded closure cap 26 which closes the exit from the barrel section 12.

The upper section 14 of the barrel has an open bottom end which communicates with and abuts the open upper end of the bottom barrel section 12. The top end of the section 14 is closed off by the top end wall 28. That wall has a central opening 32 through it, through which the shaft 152 of the mixer plunger is movable, as described below. Further, there are detent openings 34 through the opposite sides of the side wall of the upper section 14 near the top end wall 28 for supporting the wiper, as described below.

There is a breakable barrier or separator between the barrel sections 12 and 14. It comprises two separator disks 38, 39, each of a material which is impervious to and does not react with the fluent materials retained in the barrel section 12 and 14, such as a disk of metal foil. The disks are stretched across the respective open hollow spaces in the bodies and between the barrel sections 12 and 14 and close off their open ends. The barrel sections 12, 14 are held together at their abutting ends and the breakable barrier disks 38, 39 are also held in place there by the shrink tape 42 wound around the barrel sections 12, 14 at the joint between them.

Alternatively, as shown in FIGS. 14 and 15, the adjacent ends of the barrel sections 12 and 14 may have respective annular flanges 172, 174 defined on them, between which the two separator disks 38 and 39 are sandwiched. To clamp the barrel sections together, two semicircular split rings 180 are provided, each including an internal groove 182 into which the flanges 172, 174 are fitted and thereby clamped together. Tape wrapped around the ring halves holds them together.

Figure 4:
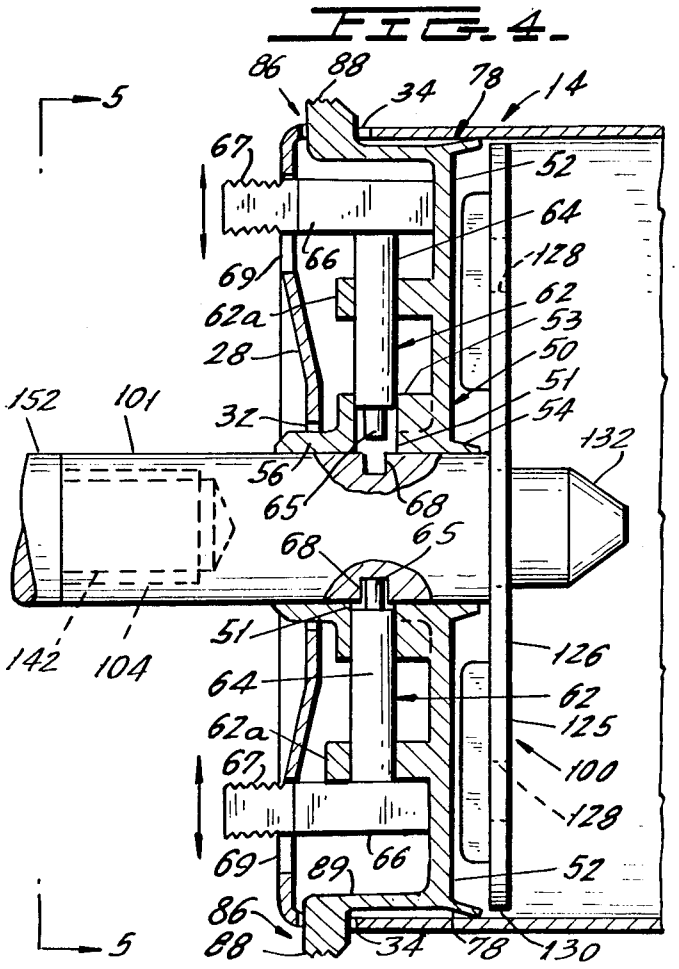
FIG. 4 is an enlarged, side elevational cross-sectional view showing the mixer, the wiper and the hub of the plunger shaft.
Figure 5:
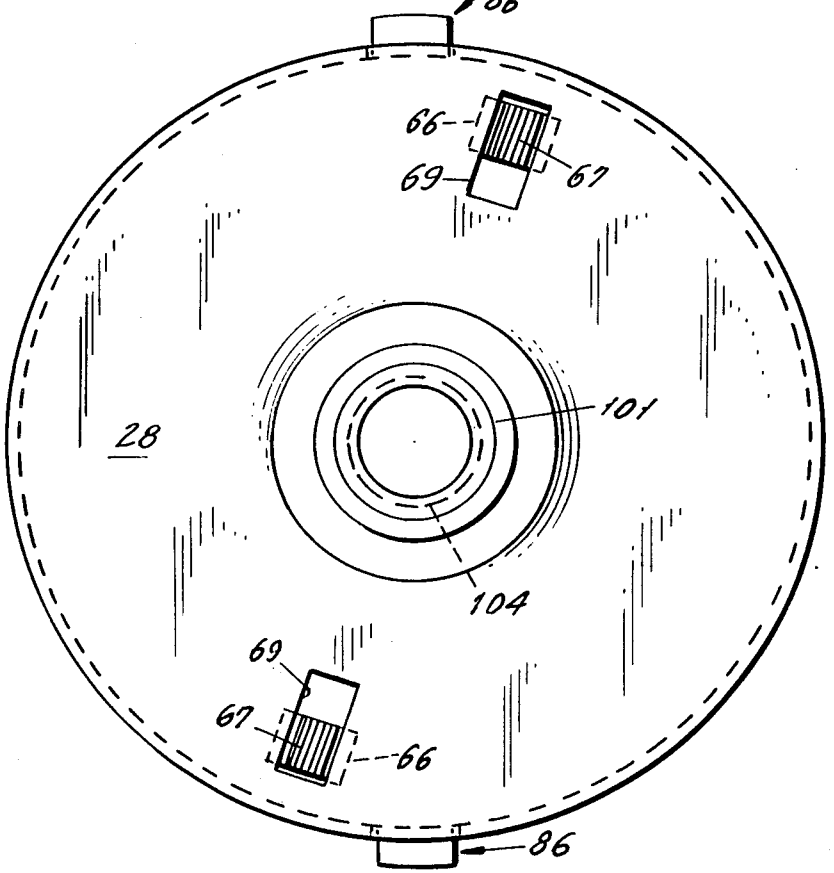
FIG. 5 is a top plan view of the mixing apparatus taken from line 5—5 of FIG. 4.
Figures 6, 7, 10, 11:
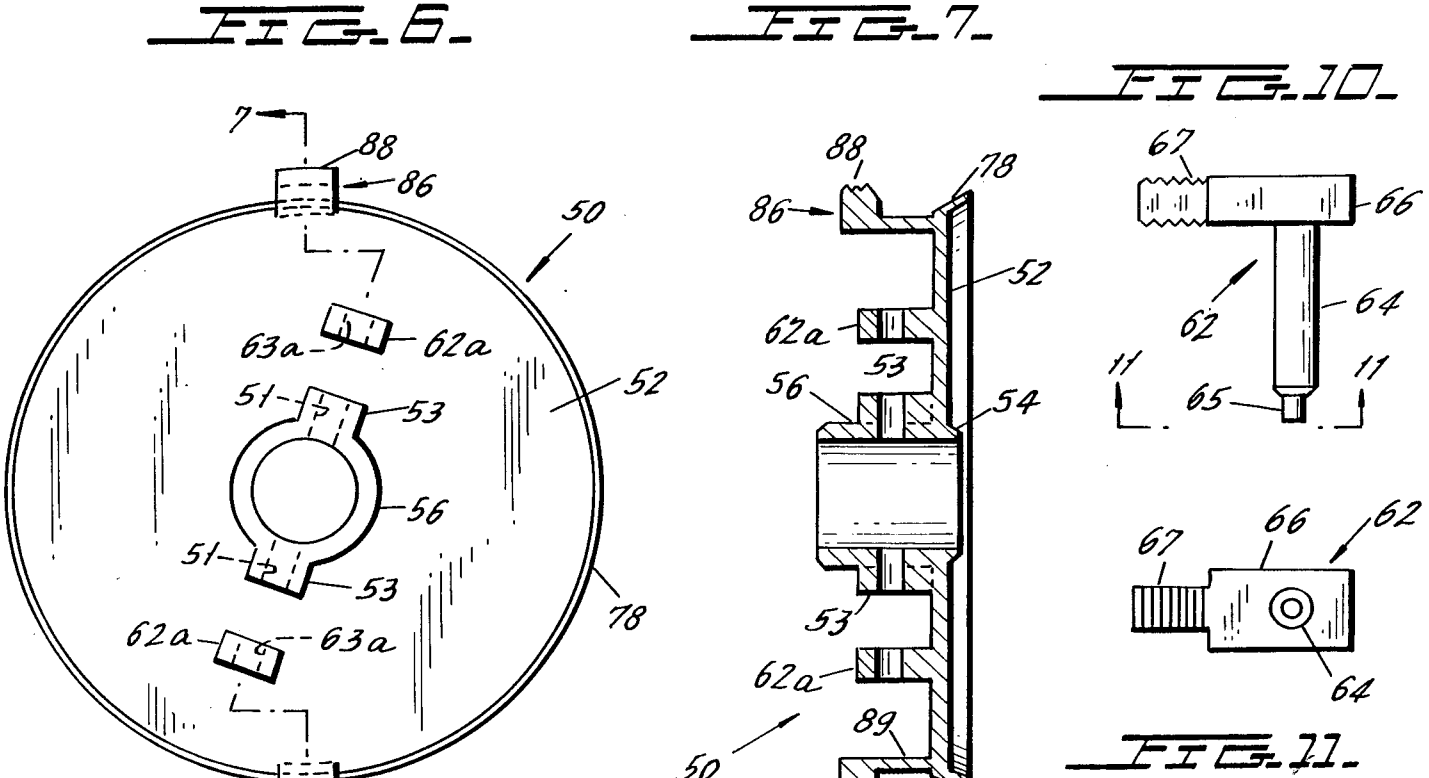
FIG. 6 is a top view of the wiper.
FIG. 7 is a cross-sectional view taken on line 7—7 of FIG. 6 of the wiper plate.
FIG. 10 is a side elevation of a latch shown in FIG. 4.
FIG. 11 is a view of the latch taken from line 11—11 of FIG. 10.

A wiper 50, shown in FIGS. 4, 6 and 7 is disposed at the top end of the barrel section 14. The wiper includes a solid annular plate-like body 52 with no openings through it.

At its radially inner end, wiper flange 54 is integrally formed on the plate-like body 52. The flange 54 is resilient to be normally self biased inwardly toward the plunger shaft 152. The wiper flange 54 wipes the plunger shaft 152 clean as the plunger is drawn out of the barrel during the below described mixing process.

The wiper 50 includes an upstanding sleeve 56 and that forms a main annular portion which surrounds the shaft 152. As can be seen in FIG. 4, over the majority of its circumference, the sleeve 56 is of uniform thickness. The sleeve 56 is provided with a pair of opposite radial openings 51 in its side wall. These openings are, in turn, framed by blocks 53 supported on plate 52 (in FIG. 4). Latches 62 (see also FIGS. 10 and 11) each compromise latch support 64 and latch detent 65, and support 64 is connected to manual latch operator 66 which is accessible to manual operation at the top surface 67.

The latches 62 are moved manually to cause the latch detents 65 to enter the annular latching groove or keyway 68 of mixer hub 101, described below, to integrate the wiper plate 52 with the mixer hub 101. Such latching is done initially before the cartridge mixer is operated to prevent premature mixing in storage and during shipment. It is also done to integrate the wiper plate and the plunger shaft 152 when, after mixing, it is desired to express or extrude the mixture through opening 24 at the end of the barrel section 12.

Guide blocks 62*a* are provided on plate 52 and include holes 63*a* aligned with holes 51 for guiding latch support 64 to provide for better control of the latches. The top wall 28 is notched at 69 to permit access to the top surfaces 67 of latch operators 66.

Alternate latches are shown in FIGS. 12 and 13. In place of guide blocks 62*a*, hook tabs 163 are formed integrally on the wiper plate. The latches 162 comprise the block-like body 166 from which the support 164 and latch detent 165 project. Operating knobs 167 are at the ends of the bodies 166. The body has grooves 168 formed along its opposite surfaces, and the latches 162 ride the tabs 163 for guiding of the latches 162 and preventing their falling away.

Annular flange 78 is provided at the outer edge of the wiper plate 52. Flange 78 presses against the interior wall of the barrel section 14 for sealing against fluent material leakage past the wiper. At two opposite locations around the flange 78, there are detenting arrangements 86. Each comprises the detent projection 88. The projection 88 is on a section 89 of flange 78 which extends up from flange 78 so that projections 88 may move resiliently away from latching position.

The projections 88 extend into respective openings 34 at the top of the upper section 14 to hold the wiper 50 in place until the wiper is to be moved into the barrel for dispensing the then mixed fluent materials, as described below. It is also desirable that wiper 50 be held adjacent top wall 28 until the mixing function is completed.

Figure 9:
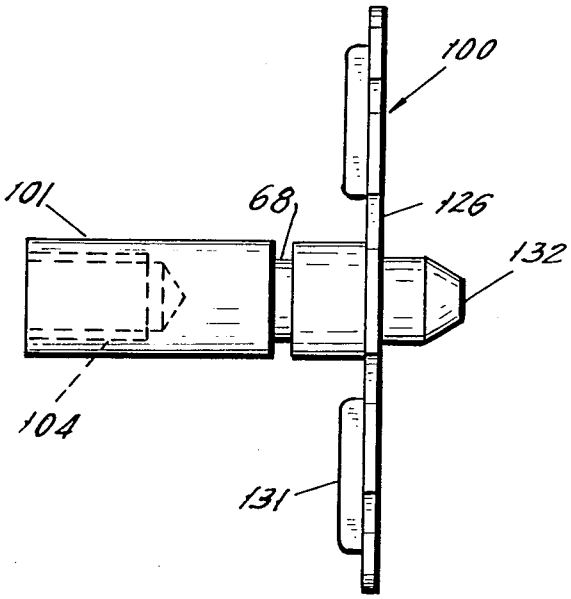
FIG. 9 is an enlarged side view of the mixer plate on the plunger shaft.
Figure 8:
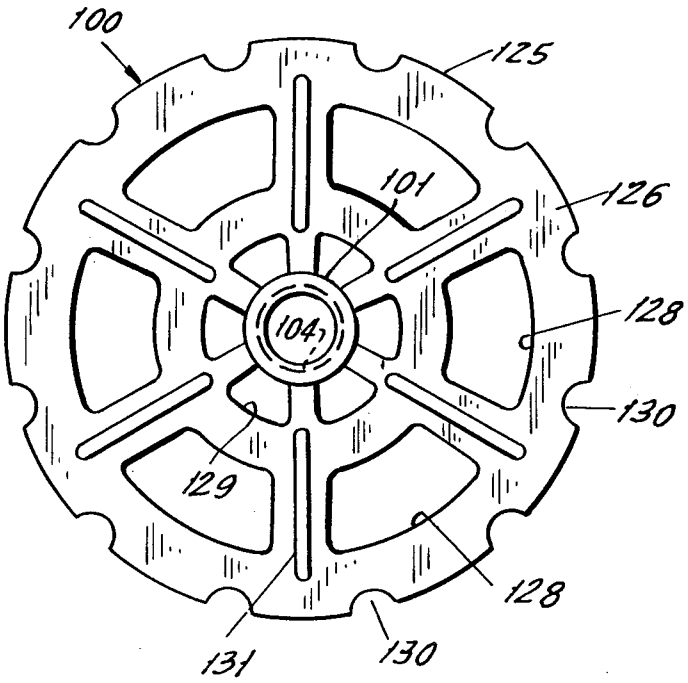
FIG. 8 is a plan view of the mixer plate to be carried at the bottom of the plunger shaft.

For mixing the materials in the barrel sections 12, 14, the mixer assembly 100 shown in FIGS. 4, 8 and 9 is provided. It includes the hub 101 which is at the bottom of the plunger shaft 152. The hub 101 has an outer diameter corresponding to the inner diameter of the wiper sleeve 56 for sealing fluent material in the barrel below the wiper. The hub has a threaded opening 104 at its top for receiving the correspondingly threaded stud 142 at the bottom end of the plunger shaft 152.

The mixer element 125 is secured at the bottom of hub 101. The mixer element 125 includes the flat plate 126. The mixer element plate 126 has a plurality of arcuately elongate openings 128 through it, through which the fluent materials may pass. Smaller arcuate openings 129 at the hub 101 perform the same function. The peripheral margin of the plate 126 has scallops or flutes 130, which also permit bypassage of the fluent materials. As the mixer element 125 is moved back and forth through the barrel sections 12, 14, the materials to be mixed are stirred and moved along by the plate, and pass through the openings 128, 129, 130, and the materials are thereby sufficiently mixed and agitated.

At the top side of the plate 126 there are a plurality of generally radial projecting paddles 131 which help stir the fluent materials as the mixer is rotated, as described below.

The bottom side of the plate 126 carries a projection 132, which is adapted to pierce the separating disks 38 and 39 and which also helps force the mixed materials out through the exit 24 from the barrel section 12 when mixing has been completed.

The mixer hub 101 is connected with the plunger shaft 152 to move together. The crank handle 140 is secured on plunger shaft 152 in a suitable manner. The user grasps the crank handle and uses it to rotate the shaft 152 while moving the mixer back and forth through the barrel sections. The rotation, plus the back and forth motion, thoroughly mixes the materials.

As previously described, the wiper plate 52 is first locked at the top of barrel section 14 by detent members 88 in openings 34. After material mixing, the latches 62 are operated to enter annular groove 68 in hub 101 and thereby interconnect wiper plate 52 and shaft 152. The detents 88 may be pushed or squeezed in to free the wiper plate 52 from the top of barrel 14.

Operation of the cartridge mixer is now described.

The mixer is delivered to the user with conventional base material in the barrel section 12 and the catalyst in the barrel section 14. For example, these might be fluent foam forming agents which when mixed together form a hardenable foam material for insulating or sealing purposes. However, the invention is not limited to particular mixable materials to be placed in the barrel sections 12, 14. The cap 26 is in place over the exit 24. The plunger shaft 142, 152 is separated from the upraised hub 101, 104 and mixer 100. Also, the latches 62, 64, 65 are delivered in the position where their ends 65 are in the groove 68 of the mixer 100.

First, the shaft 152 is screwed to hub 101 at 104, 142. Next, the latches 62 are pushed radially outwardly, thus disengaging mixer 100 from wiper 50. Any pin or device which has immobilized the plunger shaft 152 is removed, freeing the plunger to be operated. The crank handle 140 is pushed toward the main body and is possibly rotated as it is being pushed. Through the plunger shaft 152, the mixer element 125 is pushed down through the upper barrel section 14 until the projection 132 pierces the disks 38 and 39, and the mixer element 125 continues down through the bottom barrel section 12 toward wall 16. The wiper 50 anchored at detent members 88 at the top 28 of the upper barrel section, remains stationary as the handle moves. The fluent material in the barrel section 14 is pushed ahead of the mixer plate 126 down into the bottom barrel section 12, while some passes through the openings 128, 129, 130 of the mixer plate. The plunger is next drawn outwardly of the barrel by the handle 140, which again may be rotated, and the fluent material in the section 12 of the barrel is drawn upwardly toward the top wall 28 of the barrel section 14. Some of the material in front of the upwardly moving mixer element is moved along by the mixer plate 126 while other material passes through the openings 128, 129, 130. Repeated up and down motion causes the mixer 125 to fully mix the previously separated material in the barrel sections 12 and 14. Rotation of the plunger shaft and thereby of the mixer helps mix the materials. The material adhering to the hub 101 or to the plunger shaft 152 is wiped off them by the wiper flange 54 before they are withdrawn from the barrel, retaining the fluent contents in the barrel. The radially outer flange 78 and the radially inner flange 54 of the wiper, coupled with the solid body of the wiper 50, hold all of the mixed material below the wiper.

After the materials have been thoroughly mixed, they should be expelled through the outlet 24. However, because the mixer plate 126 has holes 128, 129, 130 through it, it could not completely expel the material through the opened outlet. Therefore, the wiper 50 is used for that purpose. To enable the wiper to be moved to move the material through the barrel, first, the latches 62 are operated by the operator's fingers to move the latch detents 65 inwardly to engage the annular detent notch 68 in the hub 101 of the plunger shaft 152, which integrates the wiper 50 and the shaft 152.

Next, the detent members 88 are manually deflected inwardly by the operator to disengage from holes 34. This disengages the wiper from the barrel. The cap 26 is then removed. Finally, inward movement of the shaft 152 into the barrel also moves the wiper 50 through the barrel to expel the mixed materials.

With the cap 26 removed from the barrel outlet 24, pushing the shaft 152 into the barrel pushes the mixer and wiper down through the barrel and extrudes the mixed material in the barrel out through the exit 24. The empty container can thereafter be discarded.

As an alternative to sequentially operating latches 62 and later operating detent members 88, it is possible to design them for simultaneous operation in one step. By appropriately enlarging opening 69 in the barrel top wall 28, and placing an appropriate extension on the detent member 88, the detent member will be in the path of the user's fingers moving to shift the latches 62, 67. Now, a single finger motion can operate both the detents 86 and the latches 62 simultaneously.

Although the present invention has been described in connection with preferred embodiments thereof, many variations and modifications will now become apparent to those skilled in the art. It is preferred, therefore, that the present invention be limited not be the specific disclosure herein, but only by the appended claims.

I claim:

1. A mixing apparatus for fluent materials, comprising:

a main body having an upper and a lower barrel section; each barrel section having an open end which meets the respective open end of the other barrel section, and a breakable separator between the barrel section open ends for separating the barrel sections and respective fluent materials in each of the sections; the upper barrel section having an upper end which is opposite its open end;

a mixer in the main body and a mixer shaft supporting the mixer and extending out of the upper barrel section upper end;

a combined wiper and fluent material pusher in the upper barrel section located in the vicinity of the upper end; the wiper including a fluent material impervious plate portion extending across the upper barrel section; a radially outer section attached to the plate portion of the wiper for engaging the interior of the upper barrel section in a manner which prohibits bypassage of fluent material, and which outward section is slidable along the interior of both of the barrel sections; a radially inner wiping section of the wiper which is shaped for surrounding and defining an opening through which the mixer shaft may pass;

first detent means on the wiper for engaging the upper barrel section in the vicinity of the upper end and for preventing the wiper from being moved along the upper barrel section, the first detent means being releasable to permit movement of the wiper along the upper barrel section and into the lower barrel section;

second detent means on the wiper for being moved for engaging the mixer shaft for enabling movement of the wiper through the barrel sections together with such movement of the mixer shaft;

the mixer shaft extending from the outside of the upper barrel section through the upper end thereof and through the opening in the radially inner wiping section, the shaft being sized and the wiping element opening also being sized so that the wiping element radially inner wiping section rubs the shaft as the shaft moves through the barrel sections for preventing fluent material in the upper barrel section from moving out of the upper barrel section along the shaft;

a fluent material mixer in the main body below the wiper and attached to the mixer shaft for being moved up and down through the main body as the mixer shaft is moved up and down; the mixer being shaped for moving fluent materials along the barrel sections as the mixer moves and also being shaped to permit some of the fluent material to bypass the mixer as the mixer moves thereby causing the mixing of the fluent materials in the upper and lower barrel section as the mixer moves; the mixer also being adapted for breaking the separator as the mixer initially is moved by the shaft past the separator; and a fluent material exit from the lower barrel section.

2. The mixing apparatus of claim 1, wherein the second detent means is engageable with the shaft when the shaft is raised mostly out of the upper barrel section and the mixer has been raised by the shaft to be near the upper end of the upper barrel section.

3. The mixing apparatus of claim 2, wherein the second detent means is adjacent the upper end of the upper barrel section so that it is engageable with the shaft at the upper end of the upper barrel section.

4. The mixing apparatus of claim 1, wherein the lower barrel section has a lower end opposite its open end, and the exit is at the lower end thereof.

5. The mixing apparatus of claim 1, wherein the radially inner wiping section of the wiper comprises a sleeve supported around the shaft for engaging and wrapping around the shaft for preventing the fluent materials in the body from exiting past the wiper.

6. The mixing apparatus of claim 5, wherein the wiper has a peripheral flange extending toward the upper end of the upper barrel section and wherein the first detent means are defined in the wiper flange and comprise a deflectable section of the flange carrying a detent; the upper barrel section including a surrounding wall having an opening adjacent its upper end for receiving the detent and the detent on the deflectable section being deflectable into the opening for engagement between the wiper flange detent and the wall, thereby releasably securing the wiper to the wall.

7. The mixing apparatus of claim 6, wherein the second detent means comprises a pair of movable latches supported on the wiper on opposite sides of the shaft and a notch in the shaft is adapted for receiving the latches; each of the latches being manually engageable with the shaft to cause the wiper to move with said shaft.

8. The mixing apparatus of claim 1, wherein the second detent means comprises a latch on the wiper and movable toward and away from the shaft; and means on the shaft for receiving the latch, for thereby engaging the wiper to the shaft to move together through the barrel sections.

9. The mixing apparatus of claim 1, wherein the mixer comprises a plate extending across the main body; the mixer plate being shaped for permitting fluent material to move past the mixer plate and the mixer plate also being shaped to move the fluent material in front of the direction of motion of the mixer plate along the main body, while some of that fluent material is enabled to pass the mixer plate due to the shaping thereof.

10. The mixing apparatus of claim 9, wherein the mixer plate has holes through it through which fluent material can pass.

11. The mixing apparatus of claim 10, wherein the mixer plate holes comprise scalloped shaping of the mixer plate on its periphery.

12. The mixing apparatus of claim 10, wherein the mixer plate holes comprise holes through the mixer plate in the vicinity of the mixer shaft, for preventing thereby build up of pressure of material behind the mixer plate and toward the wiper.

13. The mixing apparatus of claim 9, further comprising rotating means on the mixer shaft for rotating that shaft while the mixer is being moved in the main body.

14. The mixing apparatus of claim 13, wherein the rotation means comprising a crank by which the shaft may be rotated.

15. The mixing apparatus of claim 13, further comprising radial ribs on the mixer plate for contacting the fluent material as the mixer plate is rotated by the rotation means.

16. The mixing apparatus of claim 1, wherein the separator comprises a respective disk of breakable, thin material at each barrel section open end for closing off that end, and the disks being breakable by the mixer moving past them.

17. The mixing apparatus of claim 16, wherein the mixer has a piercing tip on the bottom side thereof and facing toward the bottom of the bottom section of the body for piercing through the separator.

18. The mixing apparatus of claim 17, wherein the fluent material exit has a narrowed neck through which material is expelled; the piercing tip on the bottom side of the mixer is shaped to the neck for moving out mixed material that is in the exit neck.

19. The mixing apparatus of claim 16, wherein the fluent material exit has a narrowed neck through which material is expelled; a tip on the bottom side of the mixer is shaped to the neck for moving out mixed material that is in the exit neck.

20. The mixing apparatus of claim 1, wherein the body and both of the barrel sections thereof are cylindrically shaped, the mixer is generally circularly shaped and the wiper is a circular disk.

21. A mixing apparatus for fluent materials, comprising:

a main body having an upper and a lower barrel section; each barrel section having an open end which meets the respective open end of the other barrel section, and a breakable separator between the barrel section open ends for separating the barrel sections and respective fluent materials in each of the sections; the upper barrel section having an upper end which is opposite its open end;

a combined wiper and fluent material pusher in the upper barrel section located in the vicinity of the upper end; the wiper including a fluent material impervious plate portion extending across the upper barrel section; a radially outer section attached to the plate portion of the wiper for engaging the interior of the upper barrel section in a manner which prohibits bypassage of fluent material, and which outward section is slidable along the interior of both of the barrel sections; a radially inner wiping section of the wiper which is shaped for surrounding and defining an opening through which a mixer shaft may pass;

first detent means on the wiper for engaging the upper barrel section in the vicinity of the upper end and for preventing the wiper from being moved along the upper barrel section, the first detent means being releasable to permit movement of the wiper along the upper barrel section and into the bottom barrel section;

second detent means on the wiper for being moved for engaging the mixer shaft for enabling movement of the wiper through the barrel sections together with such movement of the mixer shaft;

a fluent material mixer in the main body below the wiper for being moved up and down through the main body as the mixer shaft is moved up and down; the mixer being shaped for moving fluent materials along the barrel sections as the mixer moves and also being shaped to permit some of the fluent material to bypass the mixer as the mixer moves thereby causing the mixing of the fluent materials in the upper and lower barrel section as the mixer moves; the mixer also being adapted for breaking the separator as the mixer initially is moved past the separator; and a fluent material exit from the lower barrel section.

* * * * *